US006708652B2

(12) United States Patent
Oki

(10) Patent No.: US 6,708,652 B2
(45) Date of Patent: Mar. 23, 2004

(54) ENGINE VALVE TIMING APPARATUS

(75) Inventor: Kenji Oki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 80 days.

(21) Appl. No.: 10/024,173

(22) Filed: Dec. 21, 2001

(65) Prior Publication Data

US 2002/0083910 A1 Jul. 4, 2002

(30) Foreign Application Priority Data

Dec. 28, 2000 (JP) ..... 2000-403155

(51) Int. Cl.[7] ..... F16H 7/08; F02B 67/06

(52) U.S. Cl. ..... 123/41.49; 123/90.31; 123/196 R

(58) Field of Search ..... 123/41.49, 198 R, 123/90.31, 196 R

(56) References Cited

U.S. PATENT DOCUMENTS 5,706,769 A * 1/1998 Shimizu ..... 123/195 HC
5,743,229 A * 4/1998 Hosoya ..... 123/195 A
5,747,883 A * 5/1998 Hammer et al. ..... 123/41.49
5,943,986 A * 8/1999 Kern et al. ..... 123/41.49
6,079,385 A * 6/2000 Wicke ..... 123/198 R
6,089,932 A * 7/2000 Nanami et al. ..... 123/90.31
6,142,129 A * 11/2000 Hori et al. ..... 123/572
6,508,238 B2 * 1/2003 Furuya ..... 123/572

FOREIGN PATENT DOCUMENTS

JP 7-71543 A 3/1995

* cited by examiner

*Primary Examiner*—Henry C. Yuen
*Assistant Examiner*—Jason Benton
(74) *Attorney, Agent, or Firm*—Birch, Stewart, Kolasch & Birch, LLP

(57) ABSTRACT

A valve timing transmission apparatus is disclosed that increases the freedom of attachment positions for a pivot pin supporting a one end of timing chain and enables arrangement of a chain tensioner in an optimum position for tensioning of the timing chain. An opening having a diameter greater than a sprocket is provided on the drive sprocket side of an outer side wall of a timing chamber which is formed in one side wall of an engine main body and which accommodates the timing chain. A lid plate is removably secured to the engine main body so as to close the opening. Support bosses supporting both ends of the pivot pin are formed in opposite walls of the engine main body and the lid plate.

18 Claims, 8 Drawing Sheets

ENGINE VALVE TIMING APPARATUS

CROSS-REFERENCES TO RELATED APPLICATIONS

This nonprovisional application claims priority under 35 U.S.C. §119(a) on Patent Application No. 2000-403155 filed in Japan on Dec. 28, 2000, the entirety of which is herein incorporated by reference.

BACKGROUND OF THE INVENTION

1. Field of the Invention

The present invention relates to an engine valve timing transmission apparatus, and more particularly, to an apparatus where a timing chain is arranged around a drive sprocket and a driven sprocket respectively fixed to a crankshaft and a valve camshaft. An end of a tensioner, press-contacted with an outer side surface of the timing chain to apply tension to the chain is swingably attached to an engine main body via a pivot pin.

2. Description of the Background Art

A similar engine valve timing transmission apparatus is described in Japanese Published Unexamined Patent Application No. Hei 7-71543. In this type of engine valve timing transmission apparatus, a pivot pin of a tensioner is held between junction surfaces of a crankcase divided in two halves to rotatably hold a crankshaft.

However, the pivot pin is too close to a timing chain, and the tensioner cannot be provided in an optimum position for tensioning of the timing chain. Further, since the pivot pin must be attached between the junction surfaces of the crankcase when the crankshaft is held between the two halves of the divided crankcase, assembly is difficult and unreliable.

SUMMARY OF THE INVENTION

The present invention overcomes the shortcomings associated with the background art and achieves other advantages not realized by the background art.

An object of the present invention is to provide an engine valve timing transmission apparatus which increases freedom of attachment positions of the pivot pin.

A further object of the present invention is to enable placement of the chain tensioner in an optimum position for easy, reliable tensioning of the timing chain.

A further object of the present invention is to enable attachment of the pivot pin after assembly of the crankcase in order to improve the ease of assembly.

These and other objects are accomplished by an engine valve timing transmission apparatus comprising a timing chain engaging with a drive sprocket and a driven sprocket respectively fixed to a crankshaft and a valve camshaft; a chain tensioner, the chain tensioner having a first end press-contacted with an outer side surface of the timing chain to apply tension to the timing chain and swingably attached to an engine main body via a pivot pin; a timing chamber formed in a side wall of the engine main body for accommodating the timing chain; an opening having a diameter greater than the drive sprocket is provided on a side of the drive sprocket on an outer side wall of the timing chamber; and a lid plate for covering the opening is removably secured to the engine main body.

The pivot pin is held between opposite walls of the engine main body and the lid plate. The pivot pin can be reliably supported by the engine main body and the lid plate without special dropping preventing means. Further, the freedom of attachment position of the pivot pin in opposite walls of the engine main body and the lid plate increases, the pivot pin can be provided in a desired position, and the chain tensioner can be provided in an optimum position for tension of the timing chain. Furthermore, since the attachment of the pivot pin is made upon attachment of the lid plate, e.g. after assembly of the engine main body, ease of reliable assembly is improved.

Further, according to a second feature of the present invention, the engine main body is constructed with a cylinder block, a first crankcase half body connected to one end of the cylinder block, and a second crankcase half body connected to and in cooperation with the first crankcase half body and rotatably holding the crankshaft. The timing chamber is formed from the cylinder block to the second crankcase half body. The opening is provided over the first and second crankcase half bodies, and the pivot pin is held between opposite walls of the lid plate to close the opening and the second crankcase half body.

The pivot pin can be provided sufficiently away from the drive sprocket to the opposite side of the driven sprocket. Accordingly, a sufficient length of the chain tensioner can be ensured. The timing chain can be held under an approximately constant tension without influence by the extension of the chain, and the durability of the timing chain can be improved.

Further, according to a third feature of the present invention, a stator of a generator driven by the crankshaft is fixed to the lid plate. The lid plate also serves as a support base of the stator of the generator. This third feature permits a reduction in the number of parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
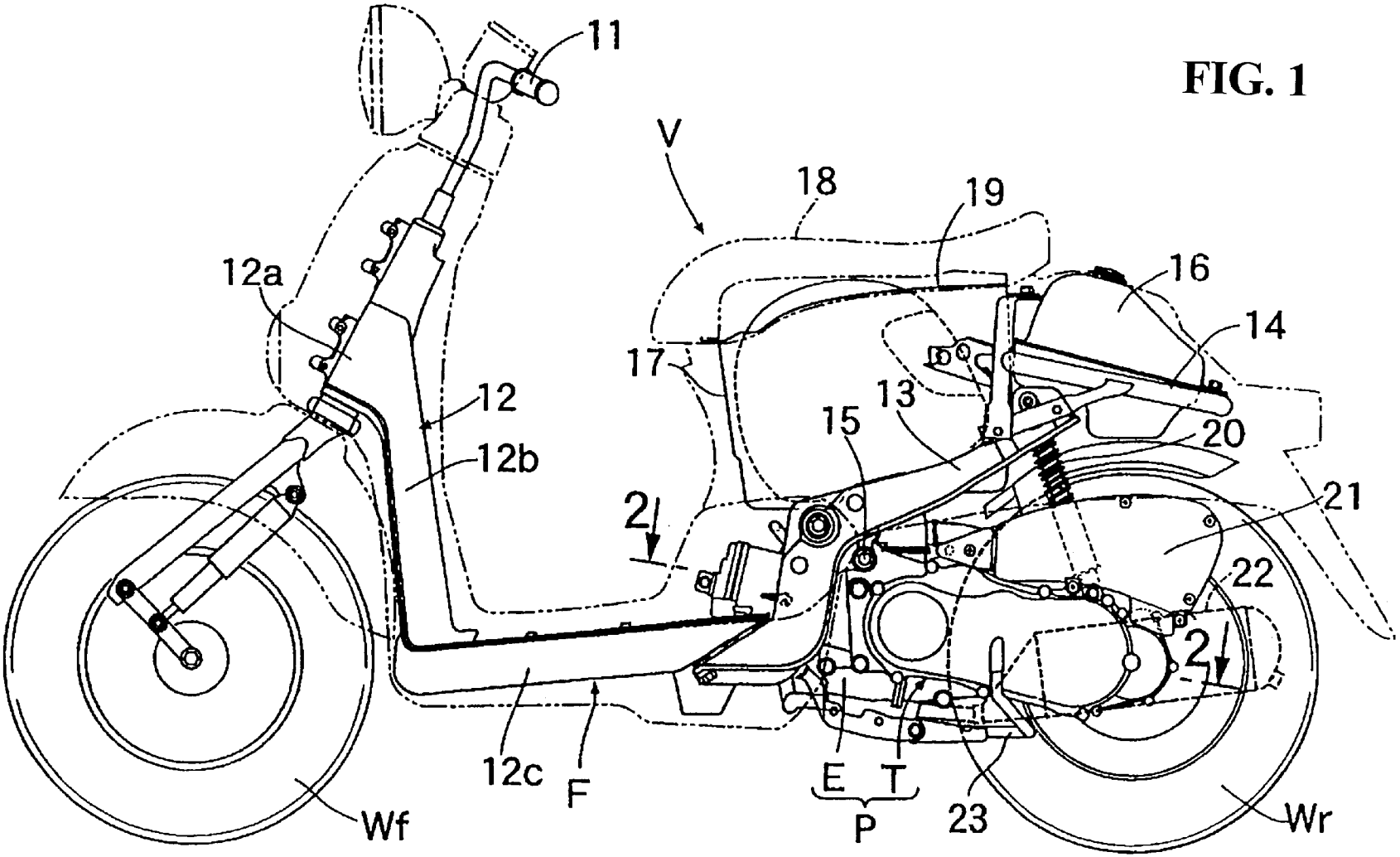
FIG. 1 is a side view of a scooter type motorcycle according to a first embodiment of the present invention.
Figure 2:
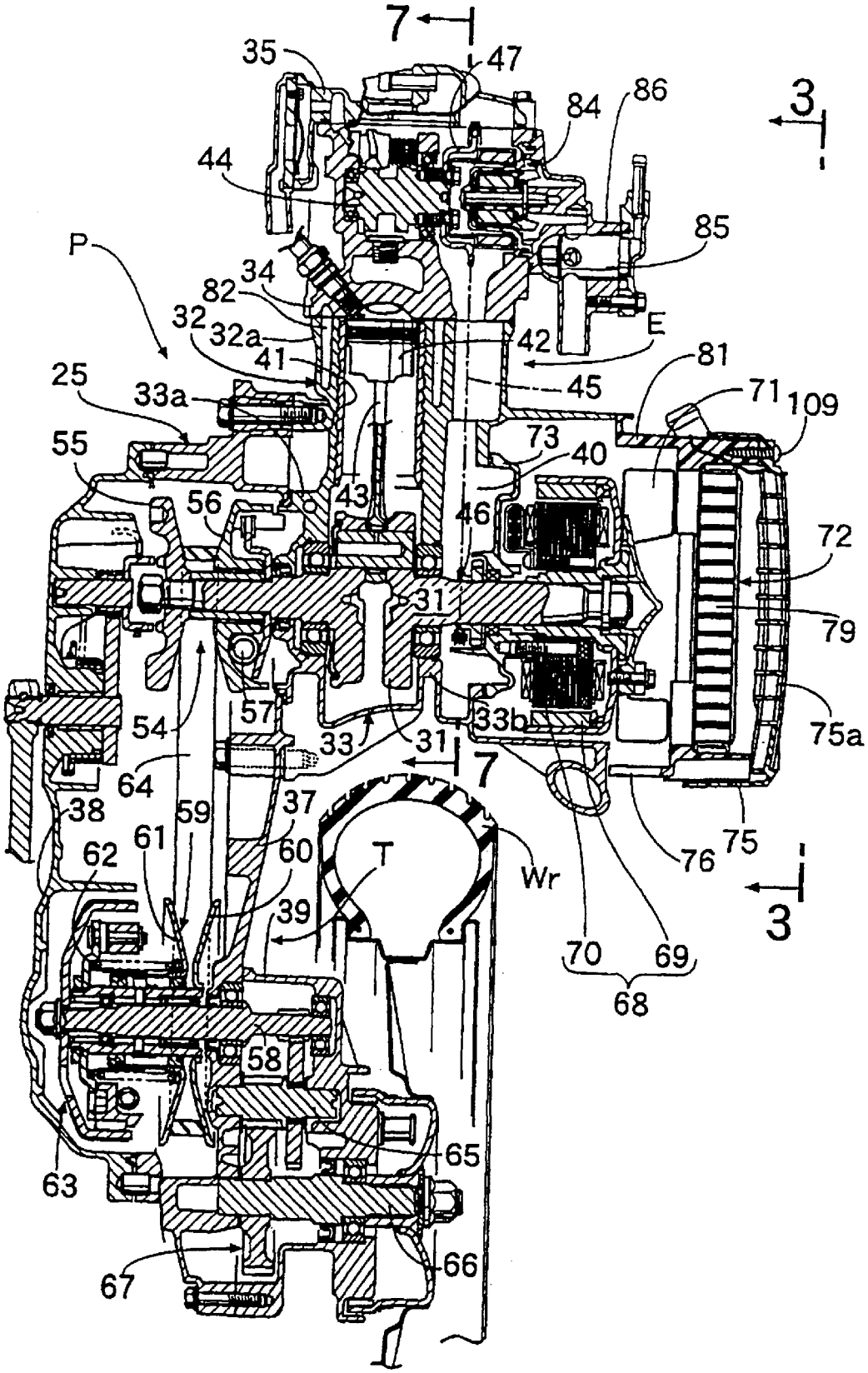
FIG. 2 is a cross-sectional view taken along line 2—2 in FIG. 1.
Figure 3:
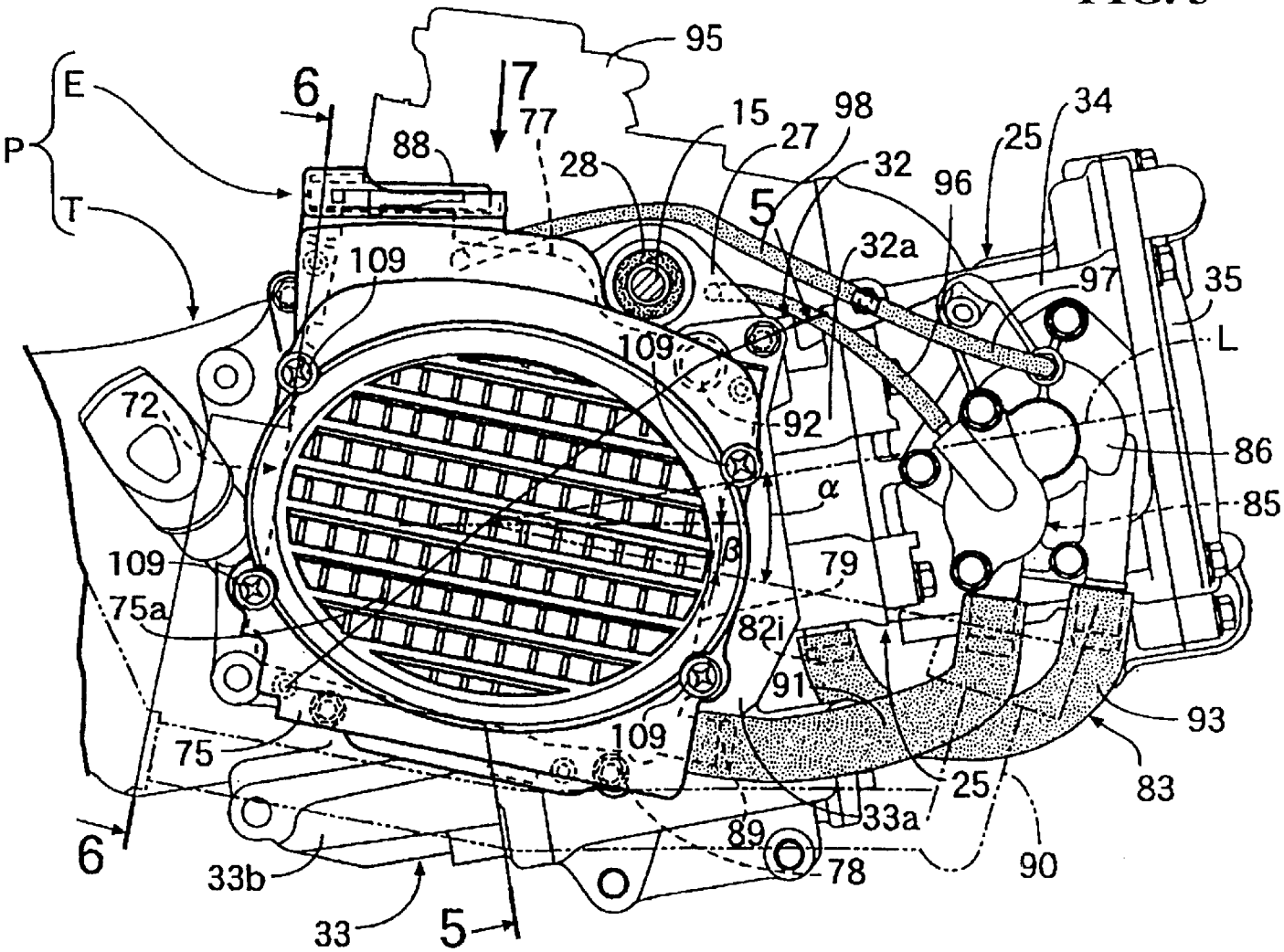
FIG. 3 is a side view taken along arrows 3—3 in FIG. 2.
Figure 4:
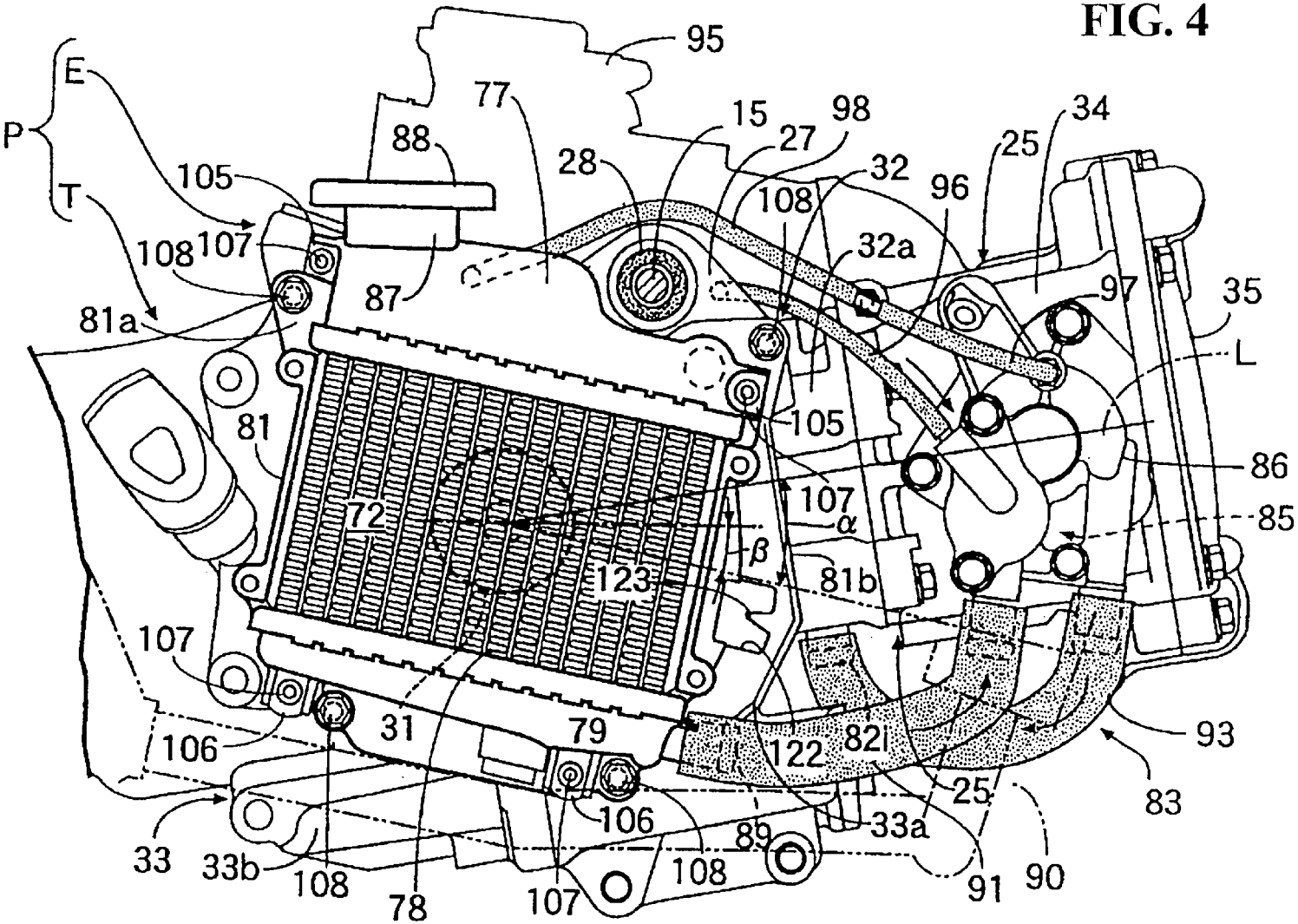
FIG. 4 is a side view corresponding to the view of FIG. 3 shown without a radiator cover.
Figure 5:
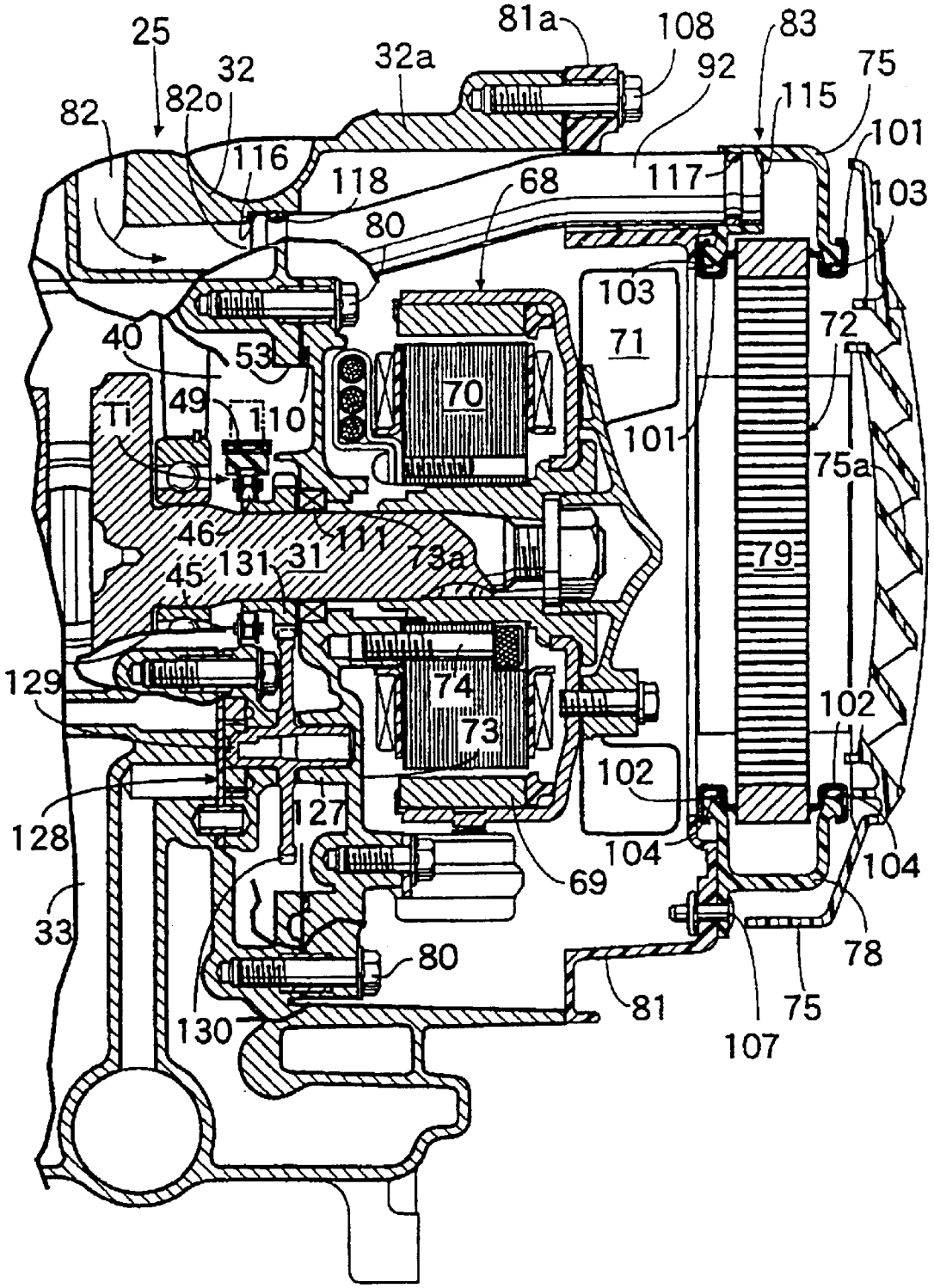
FIG. 5 is a cross-sectional view taken along line 5—5 in FIG. 3.
Figure 6:
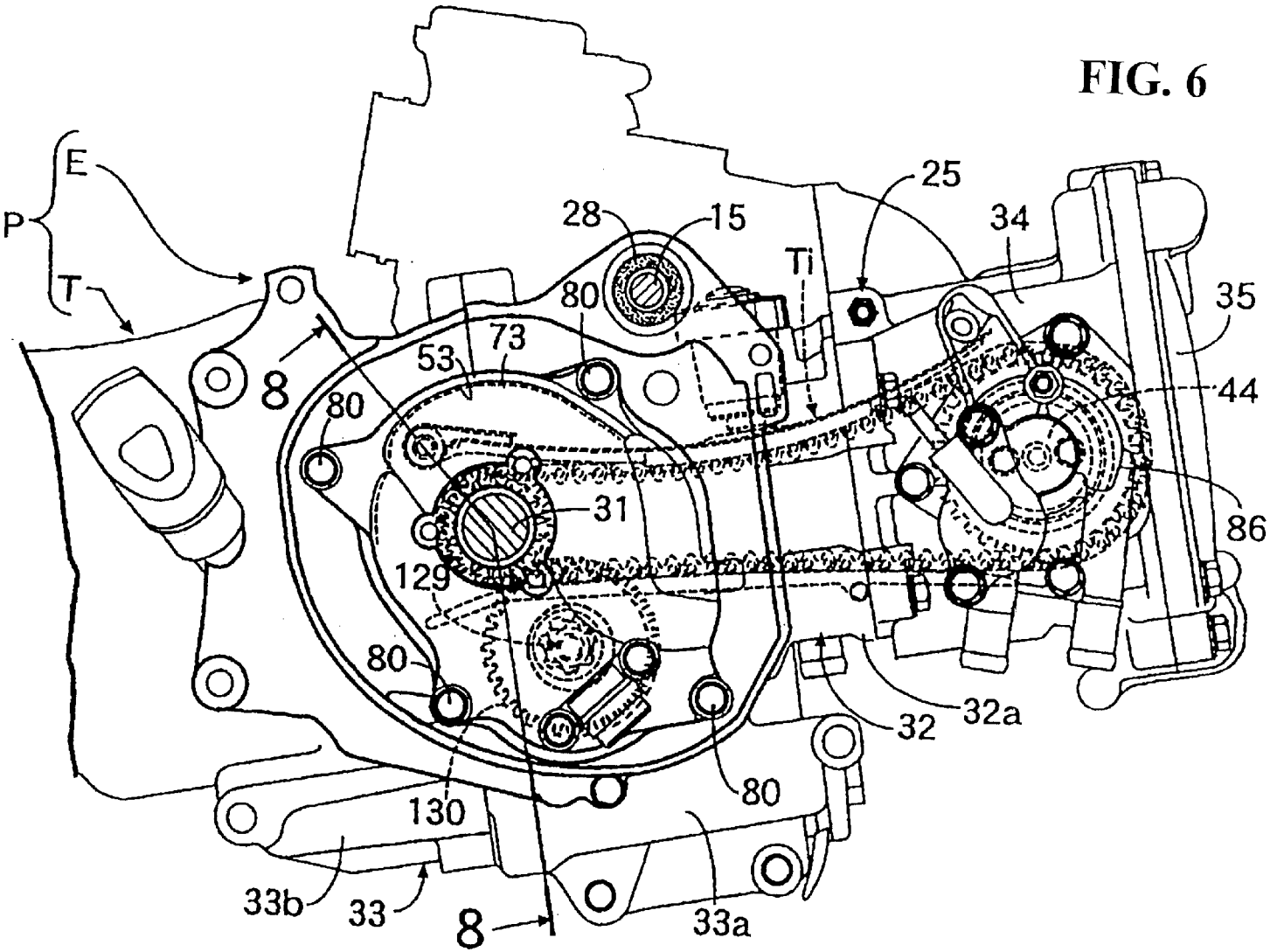
FIG. 6 is a side view corresponding to the view of FIG. 3 shown without a radiator and a generator.
Figure 7:
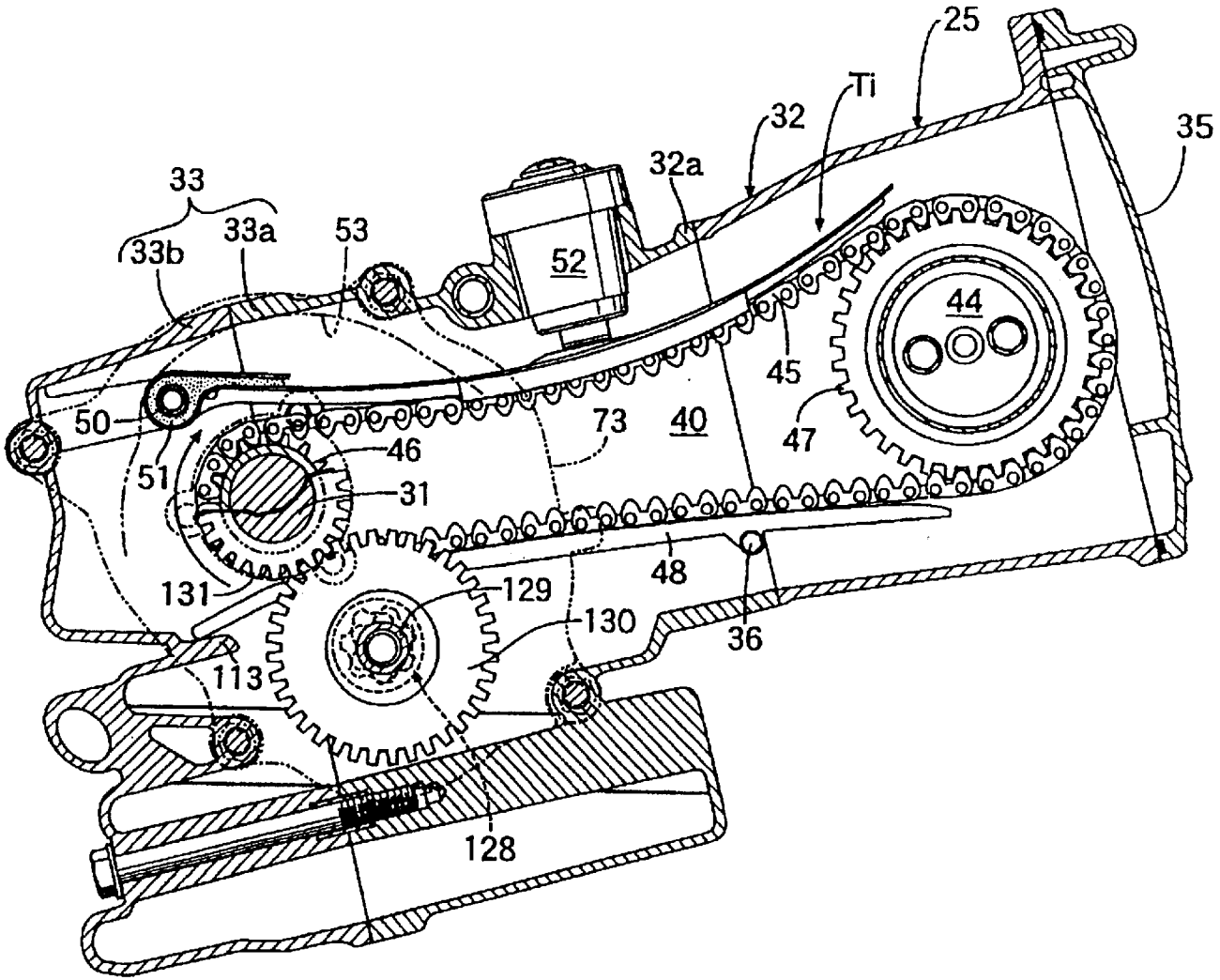
FIG. 7 is a cross-sectional view taken along line 7—7 in FIG. 2.
Figure 8:
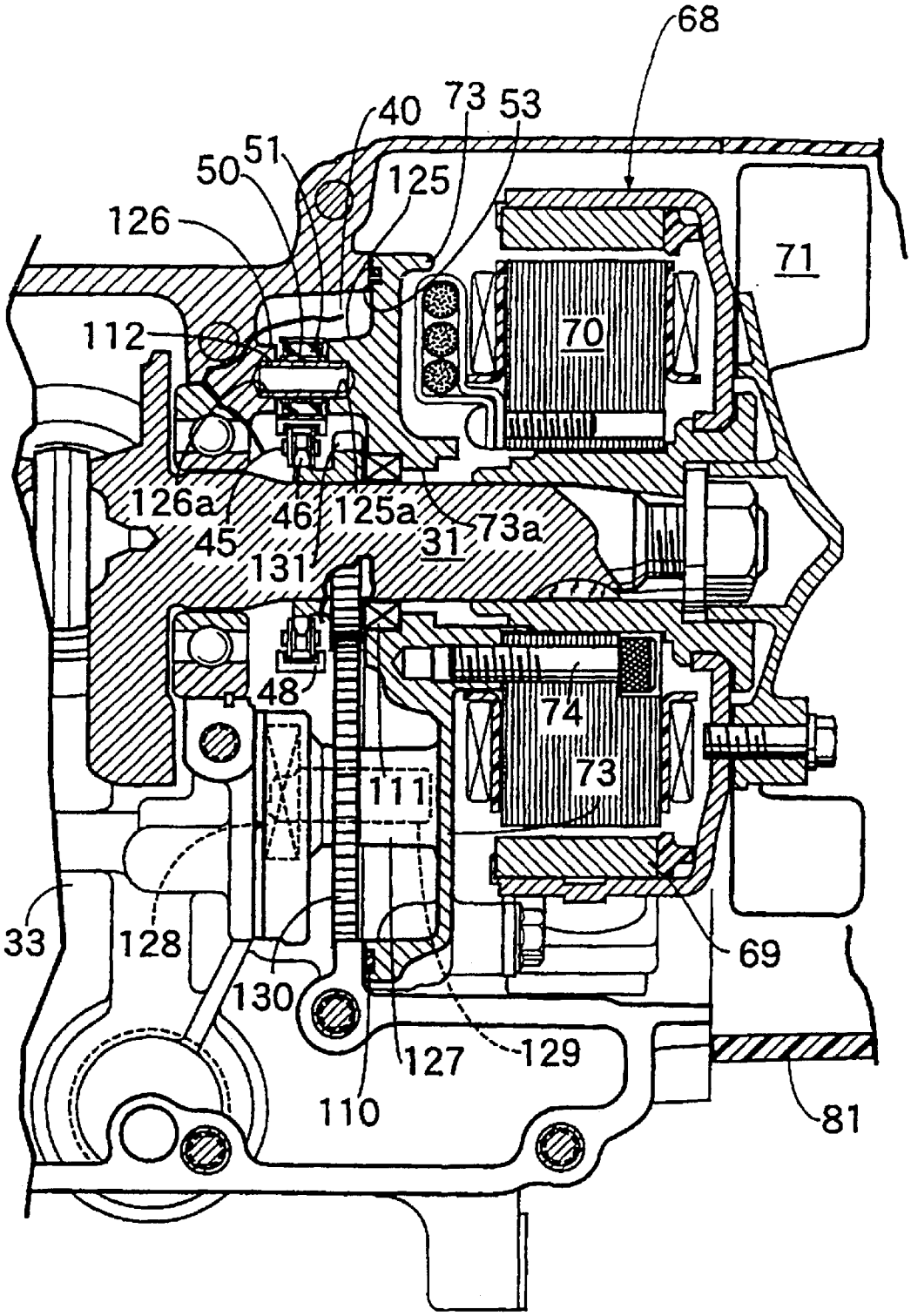
FIG. 8 is a cross-sectional view taken along line 8—8 in FIG. 6.

The present invention will hereinafter be described with reference to the accompanying drawings. FIG. 1 is a side view of a scooter type motorcycle according to a first embodiment of the present invention. FIG. 2 is a cross-sectional view taken along line 2—2 in FIG. 1. FIG. 3 is a side view taken along arrows 3—3 in FIG. 2. FIG. 4 is a side view corresponding to the view of FIG. 3 shown without a radiator cover. FIG. 5 is a cross-sectional view taken along line 5—5 in FIG. 3. FIG. 6 is a side view corresponding to the view of FIG. 3 shown without a radiator and a generator. FIG. 7 is a cross-sectional view taken along line 7—7 in FIG. 2. FIG. 8 is a cross-sectional view taken along line 8—8 in FIG. 6. A working example according to an embodiment of the present invention will be described hereinafter with reference to the accompanying drawings.

In FIG. 1, a vehicle body frame F of a scooter type motorcycle V having a front wheel Wf steered by a steering handle 11, and a rear wheel Wr driven by a swing type power unit P, is divided into three parts: a front frame 12, a center frame 13 and a rear frame 14. The front frame 12 includes an aluminum alloy casted member integrally provided with a head pipe 12*a*, a down tube 12*b* and a step floor 12*c*. The center frame 13, on which the power unit P can be upwardly-and-downwardly swung via a pivot pin 15, also includes an aluminum alloy casted member. The center frame 13 is connected to a rear end of the front frame 12. The rear frame 14, extending at a rear and upper position from the power unit P, includes a ring-shaped pipe member.

A fuel tank 16 is supported by the rear frame 14 such that the tank is surrounded by the rear frame 14. A helmet case 17 is supported on an upper surface of the center frame 13, and the helmet case 17 is openably/closably covered with a lid 19 integrally provided with a seat 18.

The power unit P has a water-cooling, monocylinder 4-cycle engine E and a belt-type continuously variable transmission T extending from a left side surface of the engine E toward the rear of the vehicle body. A rear upper surface of the continuously variable transmission T is connected to a rear end of the center frame 13 via a rear cushion (shock absorber) 20. An air cleaner 21 is supported on an upper surface of the continuously variable transmission T, a muffler 22 is supported on a right side surface of the continuously variable transmission T, and a main stand 23 which can be set upright and tilted downward is supported on a lower surface of the engine E.

In FIG. 2 through FIG. 4, an engine main body 25 of the engine E has an engine block 32 and a rear crankcase half body 33*b* divided by a dividing surface extending in upward and rearward directions along an axial line of the crankshaft 31. The engine block 32 is integrally provided with a cylinder block 32*a* having a cylinder bore 41, and a front crankcase half body 33*a*. The front crankcase half body 33*a* and the rear crankcase half body 33*b* form the crankcase 33. A cylinder head 34 is connected to a front end of the engine block 32, and a head cover 35 is connected to a front end of the cylinder head 34.

This engine main body 25 is mounted on the vehicle body frame F approximately along frontward and rearward directions of the vehicle body frame F, with a front part of an axial line L of the cylinder bore 41 being slightly raised off a centerline. A bracket 27 provided in an upper part of the engine block 32 is swingably connected to the pivot pin 15 fixed to the center frame 13 of the vehicle body frame F via a rubber mount 28.

The continuously variable belt-type transmission T has a right casing 37 and a left casing 38 connected to each other. A front right side surface of the right casing 37 is connected to a left side surface of the front and rear crankcase half bodies 32 and 33. Further, a deceleration casing 39 is connected to a rear right side surface of the right casing 37.

A piston 42 slidably engaged in the cylinder bore 41 of the engine block 32 is connected to the crankshaft 31 via a connecting rod 43. A camshaft 44 is rotatably supported in the cylinder head 34. An intake valve and an exhaust valve (not shown) provided in the cylinder head 34 are opened/closed by the camshaft 44.

As shown in FIG. 2, and FIG. 5 through FIG. 8, a timing chamber 40 is formed in one side wall of the crankcase 33, cylinder block 32*a* and the cylinder head 34. The timing chamber 40 accommodates an endless timing chain 45, placed around a drive sprocket 46 provided on the crankshaft 31 and a driven sprocket 47 provided on the camshaft 44. The drive sprocket 46, the driven sprocket 47 and the timing chain 45 forms a timing transmission apparatus Ti to reduce the rotation of the crankshaft 31 by half and to transmit this rotational force to the camshaft 44. The camshaft 44 then opens/closes the intake and exhaust valves (not shown) by its controlled rotation.

Further, a chain guide 48 for guiding the running of the timing chain 45 on the tension side, and a chain tensioner 49 for applying tension to the timing chain 45 on the loose side, are also provided in the timing chamber 40. The chain guide 48 is bent into an arc shape. One end of the chain guide is received by a shelf-shaped support 113 on an inner wall of the rear crankcase half body 33*b* and the other end of the chain guide is swingably attached to the cylinder block 32*a* with a bolt 36 such that the chain guide is in sliding contact with the outer side surface of the timing chain 45 on the tension side, approximately over the entire length.

The chain tensioner 49 is also bent to have an arc shape, with a curvature greater than that of the chain guide 48. The chain tensioner 49 mainly presses a central portion of the outer side surface of the timing chain 45 on the loose side. A bush 50 connected to one end of the tensioner via a ring-shaped elastic member 51 is rotatably supported by the pivot pin 112 provided in a position away from the drive sprocket 46 to the opposite side to the driven sprocket 47 (an attaching structure of the pivot pin will be described later), and the other end of the chain tensioner 49 is a free end. A lifter 52 to press a central portion rear surface of the chain tensioner 49 against the timing chain 45 side by a constant pressing force is provided in the cylinder block 32*a*. Thus, the timing chain 45 is provided with a constant tension from the chain tensioner 49.

The front and rear crankcase half bodies 33*a* and 33*b* are provided with an opening 53 having a diameter sufficiently greater than the drive sprocket 46 around the crankshaft 31 in a portion corresponding to an outer side wall of the timing chamber 40. The timing chain 45 is secured in a position around the drive sprocket 46 through the opening 53. A lid plate 73 fixed to the front and rear crankcase half bodies 33*a* and 33*b* with a plurality of bolts 74 closes the opening 53.

An O-ring 110 is inserted between junction surfaces of both crankcase half bodies 33*a*, 33*b* and the lid plate 73. An oil seal 111 in tight contact with an outer peripheral surface of the crankshaft 31 is applied to a through hole 73*a* of the lid plate 73 formed through the crankshaft 31. Accordingly, the timing chamber 40 is securely maintained with an oil seal.

The attachment structure of the pivot pin 112 supporting the chain tensioner 49 will be described hereinafter. As clearly shown in FIG. 6 through FIG. 8, a pair of support bosses 125 and 126 with bottomed holes 125*a* and 126*a* opposite to each other in desired position of the pivot pin 112 are integrally projected from opposite walls of the lid plate 73 and the crankcase 33. The bush 50 of the chain tensioner 49 is provided between both support bosses 125 and 126, and both ends of the pivot pin 112 rotatably inserted through the bush 50 are engaged with the bottomed holes 125*a* and 126*a* of the support bosses 125 and 126. These bottoms prevent movement of the pivot pin 112 in an axial direction.

Accordingly, the pivot pin 112 is reliably supported by the crankcase 33 and the lid plate 73 without special dropping prevention means. Further, as the crankcase 33 and the lid plate 73 are arranged in positions opposite to each other in a wide range around the drive sprocket 46, the freedom of arrangement for the support bosses 125 and 126 supporting the pivot pin 112 increases. The pivot pin 112 can be supported at a desired position, and the chain tensioner can be provided in an optimum position for tensioning of the timing chain.

As in the illustrated example, if the support bosses 125 and 126 are provided on opposite walls of the rear crankcase half body 33*b* and the lid plate 73, the pivot pin 112 supported by the bosses can be provided sufficiently away from the drive sprocket 46 to the opposite side to the driven sprocket 47. As a result, a sufficient length of the chain tensioner 49, e.g. a sufficient distance between the pivot pin 112 and the lifter 52, is ensured. The timing chain 45 can be held under an approximately constant tension without influence by the extension of the chain, thus the durability of the timing chain 45 can be improved.

Further, since the attachment of the pivot pin 112 is performed upon attachment of the lid plate 73 to the front and rear crankcase half bodies 33*a* and 33*b*, after connection of the front and rear crankcase half bodies holding the crankshaft 31, assembly can be easily made.

In FIG. 8, a bearing boss 127 projecting toward the timing chamber 40 side is integrally formed with the lid plate 73 and rotatably supports a rotor shaft 129 of an oil pump 128. In this manner, the lid plate 73 also serves as a support member of the rotor shaft 129, which contributes to a reduction of the number of required parts and assembly steps of the oil pump 128. The rotor shaft 129 is driven from the crankshaft 31 via a large-diameter gear 130 fixed to the rotor shaft and a small-diameter gear 131 integrally connected to one end of the drive sprocket 46.

In FIG. 5, a rotor 69 is fixed to the right end side of the crankshaft 31. A stator 70, forming an alternator 68 in combination with the rotor 69, is fixed to the lid plate 73 with plural bolts 74. The rotor 69 surrounds the stator 70. Accordingly, the lid plate 73 also serves as an attachment base of the stator 70, and contributes to the reduction of the number of parts.

A cooling fan 71 is fixed to a right end of the crankshaft 31 in a position exterior to the alternator 68. A radiator 72 is provided so as to hold the cooling fan 71 between the radiator 72 and the alternator 68. The radiator 72 is attached to the engine main body 25 via a shroud 81 surrounding the cooling fan 71.

The radiator 72 is constructed with upper and lower tanks 77 and 78, provided at an interval, and a radiating core 79 connecting these tanks 77 and 78 while mutually communicating with the inside of these tanks. The radiating core 79 is made of metal having high radiation qualities. Respective pairs of connection projection pieces 101, 101; 102, 102 are projected leftward and rightward from both upper and lower ends. The upper connection projection pieces 101, 101 are swaged with both left and right ends of the upper tank 77 having its lower surface opened, with seal members 103, 103 held therebetween. The lower connection projection pieces 102, 102 are swaged with both left and right ends of the lower tank 78 having its upper surface opened, with seal members 104, 104 held therebetween. The upper and lower tanks 77 and 78 are formed of synthetic resin.

Connection flanges 105 and 106 are integrally formed with the upper and lower tanks 77 and 78, and one end of the shroud 81 of elastic material such as synthetic resin is fixed to these flanges with a plurality of rivets 107. A connection flange 81*a* is integrally formed with the other end of the shroud 81, and the connection flange 81*a* is fixed to the engine main body 25 with a plurality of bolts 108.

The outer periphery of the radiator 72 is covered with a radiator cover 75 of synthetic resin fixed to the shroud 81 with a plurality of screws 109. A grille 75*a* integrally formed with the radiator cover 75 is provided in a position opposite to a front surface of the radiating core 79. A cooling wind is introduced from the outside through the grille 75*a* to the radiating core 79.

Referring to FIG. 6 and FIG. 8, plural discharge ports 76 are provided in the shroud 81 at the side of the cooling fan 71. Upon actuation of the cooling fan 71, air introduced from the grille 75*a* is passed through the radiating core 79 of the radiator 72, and the radiating core 79 is cooled down. The air is discharged from the discharge ports 76 to the outside. Thus, cooling water in the radiator 72 is also cooled.

The radiator 72 forms a part of a cooling device 83 to circulate cooling water in a water jacket 82 provided in the cylinder block 32*a* of the engine block 32 and the cylinder head 34 in the engine main body 25. The cooling device 83 includes a water pump 84 for supplying cooling water to the water jacket 82. The radiator 72 is inserted between the water jacket 82 and an intake port of the water pump 84. A thermostat 85 selects an operating state for either restoring the cooling water from the water jacket 82 to the water pump 84 (thereby avoiding the radiator 72) or restoring the cooling water from the water jacket 82 through the radiator 72 to the water pump 84 in accordance with the cooling water temperature.

A thermostat case 86 accommodating the thermostat 85 is connected to a right side surface of the cylinder head 34. The water pump 84 is provided on a right end of the camshaft 44 and is accommodated in a space surrounded by the cylinder head 34 and the thermostat case 86.

An upwardly-extending water supply port tube 87 is integrally provided with one end of the upper tank 77 along the frontward and rearward directions of the vehicle body frame F (in this embodiment, a rear end). A water supply cap 88 opened/closed by rotational operation is attached to an upper end of the water supply port tube 87. Further, a forwardly-projecting connection pipe 89 is integrally provided with the other end of the lower tank 78 along the frontward and rearward directions of the vehicle body frame F (in this embodiment, a front end).

This radiator 72 is attached to the engine main body 25 as described above in a position tilted at an angle a to the axial line L of the cylinder bore 41 of the engine main body 25. When the engine main body 25 is mounted on the vehicle body frame F, the radiator 72 is frontwardly tilted at an angle b to a horizontal plane. The water supply cap 88 is provided in the highest position in the cooling device 83 and the connection pipe 89 is provided in the lowest position in the cooling device 83.

The foregoing arrangement avoids increases in cost by forming the radiator 72 in a special shape and providing a water supply cap in a tank connected to the radiator 72 and provided aside from the radiator 72, attains a comparatively large head difference in the cooling device 83 upon water supply from the water supply port tube 87, and improves air removal characteristics and water supply performance from the water supply port tube 87.

Further, in the case where the radiator 72 is tilted at an angle a to the axial line L of the cylinder bore 41 as described above, the radiator 72 can be provided to avoid the pivot pin 25 to support the engine main body 25 on the vehicle body frame F. Further, adequate space to hold an exhaust pipe 90 connected to an exhaust port of the cylinder head 32 is ensured in the rear of the radiator 72 and the freedom of arrangement of the exhaust pipe 90 can be improved.

One end of a flexible first conduit 91 comprising a rubber hose or the like, to guide the cooling water in the radiator 72 to the thermostat 85 side, is connected to the connection pipe 89 of the radiator 72. The other end of the first conduit 91 is connected to the thermostat case 86.

The radiator 72 is provided in a position where at least a part (a front part in this embodiment) of the upper tank 77 is overlapped with the cylinder block 32*a* of the engine main body 25, in a side view. A connection hole 115 connected to the inside of the upper tank 77 and a connection hole 116 connected to an exit 82 in an upper part of the water jacket 82 are provided in the upper tank 77 and the cylinder block 32*a*, within a region where the upper tank 77 and the cylinder block 32*a* overlap with each other (as seen in a side view).

Both ends of a second conduit 92 comprising a metal pipe or the like having rigidity are engaged with these connection holes 115 and 116 along a fastening direction of the bolts 108 via seal members 117 and 118, e.g. O-rings. The second conduit 92 is provided so as to be inserted through a through hole 119 provided in the shroud 81 in a non-contact state. Further, a gap to allow swing movement of the second conduit 92 at a slight angle while elastically deforming the seal members 117 and 118 is provided in an engagement portion between the second conduit 92 and the connection holes 115 and 116.

Further, one end of a flexible third conduit 93 comprising a rubber hose or the like, to guide the cooling water from the water pump 84, is connected to the thermostat case 86. The other end of the third conduit 93 is connected to an entrance 82*i* in a lower part of the water jacket 82 projected from a lower surface of the cylinder block 32*a*.

A pipe line (not shown) to guide the cooling water from the water jacket 82 so as to humidify a carburetor 95 is connected to the carburetor 95 connected to an inlet port of the cylinder head 32. A flexible fourth conduit 96 comprising a rubber hose or the like, to guide the cooling water, which humidified the carburetor 95 to the thermostat 85, is connected to the thermostat case 86.

A flexible fifth conduit 97 comprising a rubber hose or the like, to remove air from the water pump 84, is connected to an upper part of the thermostat case 86. The fifth conduit 97 and a conduit (not shown) connected to the upper part of the cylinder block 32*a* to remove air from an upper part in the water jacket 82 are connected to a flexible sixth conduit 98 comprising a rubber hose or the like. The sixth conduit 98 is connected to a rear side upper part of the upper tank 77 in the radiator 72.

Further, one end of a flexible seventh conduit 100 comprising a rubber hose or the like is connected to the water supply port tube 87, and the other end of the seventh conduit 100 is connected to a reservoir (not shown), opened in atmosphere and provided aside from the radiator 72. When the temperature of the cooling water in the radiator 72 becomes high and the water expands, excessive cooling water overflows to the reservoir. When the temperature of the cooling water in the radiator 72 becomes low, the cooling water is restored from the reservoir to the radiator 72. By this movement of cooling water between the radiator 72 and the reservoir, air stored in the water supply port tube 87 is discharged to the reservoir. That is, adequate air removal from the cooling device 83 can be achieved even when the engine E is running.

Then, in a status where warming up of the engine E is complete, the cooling water discharged from the water pump 84 driven by the camshaft 44 is supplied through the thermostat case 86 and the third conduit 93 to the water jacket 82 in the engine block 32 and the cylinder head 34. When the cooling water passes through the water jacket 82, it cools the engine E. The cooling water then is sent via the second conduit 92 to the upper tank 77 of the radiator 72. Then, the cooling water, the temperature of which has been lowered when the water flowed from the upper tank 77 via the cooling core 79 to the lower tank 78, is taken into the water pump 84 via the first conduit 91 and the thermostat 85.

On the other hand, when the engine E is warmed up and the temperature of the cooling water is low, the thermostat 85 is actuated to circulate the cooling water while avoiding the radiator 72. The cooling water is circulated, without passing through the radiator 72, through the water jacket 82, the carburetor 95 and the water pump 84, in order to raise the temperature rapidly.

Since the upper and lower tanks 77 and 78 of the radiator 72 are made of light-weight synthetic resin, the weight of the radiator 72 can be greatly reduced. Further, since the shroud 81 to guide the cooling wind that passed through the radiator 72 to the outside from the discharge ports 76 is made of elastic material and the radiator 72 is attached to the engine main body 25 via the shroud, the shroud 81 absorbs engine E vibration by its own elasticity, and prevents additional vibration from being transferred from the engine E to the radiator 72.

The shroud 81 serves a role of vibration isolation by blocking transmission of vibration from the engine E to the radiator 72 in addition to its original function to guide the cooling wind from the radiator 72. Accordingly, specialized vibration isolation means for the radiator 72 is unnecessary, and simplification of the structure and subsequent cost reduction can be attained.

Further, since the radiator 72 is light weight as described above, the load capacitance of the shroud 81 can be reduced. Accordingly, the thickness of the shroud 81 can be reduced, and by extension, further improvement in vibration isolation function and weight reduction can be attained. Since the radiator 72 is attached to the engine E in the power unit P, which connected to the vehicle body frame F via the pivot pin 15 and supported via the rear cushion 20, and which swings upwardly and downwardly with the rear wheel Wr, the above-described weight reduction of the radiator 72 and the shroud 81 reduces spring load and contributes to improvement in driving feeling.

Again referring to FIG. 2, a drive pulley 54 is provided at a left end of the crankshaft 31 projecting inside the right casing 37 and the left casing 38. The drive pulley 54 has a fixed pulley half body 55 fixed to the crankshaft 31 and a movable pulley half body 56 approachable/withdrawable to/from the fixed pulley half body 55. The movable pulley 56 is pressed, by a centrifugal weight 57 moving radial-outwardly in correspondence with increments in the number of revolutions of the crankshaft 31, in a direction approaching to the fixed pulley half body 55.

A driven pulley 59, provided on an output shaft 58 supported between a rear part of the right casing 37 and the deceleration casing 39, has a fixed pulley half body 60 rotatably supported relatively to the output shaft 58. A movable pulley half body 61 approachable/withdrawable to/from the fixed pulley half body 60, and the movable pulley half body 61 is pressed by a spring 62 toward the fixed pulley half body 60. Further, a take-off clutch 63 is provided between the fixed pulley half body 60 and the output shaft 58. An endless V-belt 64 is placed around the drive pulley 54 and the driven pulley 59.

An intermediate shaft 65 and a vehicle axle 66 parallel to the output shaft 58 are supported between the right casing 37 and the deceleration casing 39. A deceleration gear array 67 is provided among the output shaft 58, the intermediate shaft 65 and the vehicle axle 66. The rear wheel Wr is spline-engaged with a right end of the vehicle axle 66 projecting rightward through the deceleration casing 39.

Therefore, the rotation power of the crankshaft 31 is transmitted to the drive pulley 54. The rotational energy is then transmitted from the drive pulley 54, via the V belt 64, the driven pulley 59, the take-off clutch 63 and the deceleration gear array 67, to the rear wheel Wr.

Upon low-speed revolution of the engine E, as a centrifugal force acting on the centrifugal weight 57 of the drive pulley 54 is small, a groove width between the fixed pulley half body 60 and the movable pulley half body 61 is reduced by the spring 62 of the driven pulley 59. The transmission gear ratio is LOW in this arrangement. From this state, if the number of revolutions of the crankshaft 31 is increased, the centrifugal force acting upon the centrifugal weight 57 increases and a groove width between the fixed pulley half body 55 and the movable pulley half body 56 of the drive pulley 54 decreases. The groove width between the fixed pulley half body 60 and the movable pulley half body 61 of the driven pulley 59 increases. Accordingly, the transmission gear ratio continuously varies from LOW toward TOP (HIGH).

The present invention is not limited to the above described embodiments, but various design changes can be made without departing from the scope of subject matter of the present invention. For example, the present invention is applicable to various vehicles such as an automatic three-wheeled vehicle other than the above motorcycle V or scooter type vehicle.

As described above, according to the first feature of the present invention, in an engine valve timing transmission apparatus, a timing chain is placed around a drive sprocket and a driven sprocket respectively fixed to a crankshaft and a valve camshaft. An end of a tensioner, press-contacted with an outer side surface of the timing chain to apply tension to the chain, is swingably attached to an engine main body via a pivot pin. An opening having a diameter greater than the sprocket is provided on the side of the drive sprocket on an outer side wall of a timing chamber accommodating the timing chain, formed in one side wall of the engine main body. A lid plate to close the opening is removably fixed to the engine main body.

The pivot pin is held between opposite walls of the engine main body and the lid plate. The pivot pin can be reliably supported by the engine main body and the lid plate without special dropping preventing means. Further, the freedom of attachment position of the pivot pin in opposite walls of the engine main body and the lid plate increases, the pivot pin can be provided in a desired position, and the chain tensioner can be provided in an optimum position for tension of the timing chain. Furthermore, since the attachment of the pivot pin is made upon attachment of the lid plate, e.g. after assembly of the engine main body, ease of reliable assembly is improved.

Further, according to a second feature of the present invention, the engine main body is constructed with a cylinder block, a first crankcase half body connected to one end of the cylinder block, and a second crankcase half body connected to and in cooperation with the first crankcase half body and rotatably holding the crankshaft. The timing chamber is formed from the cylinder block to the second crankcase half body. The opening is provided over the first and second crankcase half bodies, and the pivot pin is held between opposite walls of the lid plate to close the opening and the second crankcase half body.

The pivot pin can be provided sufficiently away from the drive sprocket to the opposite side of the driven sprocket. Accordingly, a sufficient length of the chain tensioner can be ensured. The timing chain can be held under an approximately constant tension without influence by the extension of the chain, and the durability of the timing chain can be improved.

Further, according to a third feature of the present invention, a stator of a generator driven by the crankshaft is fixed to the lid plate. The lid plate also serves as a support base of the stator of the generator. This third feature permits a reduction in the number of parts.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine valve timing transmission apparatus comprising:

a timing chain engaging with a drive sprocket and a driven sprocket respectively fixed to a crankshaft and a valve camshaft;

a chain tensioner, said chain tensioner having a first end press-contacted with an outer side surface of the timing chain to apply tension to the timing chain and swingably attached to an engine main body via a pivot pin;

a timing chamber formed in a side wall of the engine main body for accommodating the timing chain;

an opening having a diameter greater than the drive sprocket is provided on a side of the drive sprocket on an outer side wall of the timing chamber;

a lid plate for covering the opening is removably secured to the engine main body; and a bearing boss projecting toward the timing chamber and integrally formed with the lid plate, said bearing boss rotatably supporting a rotor shaft of an oil pump.

2. An engine valve timing transmission apparatus comprising:

a timing chain engaging with a drive sprocket and a driven sprocket respectively fixed to a crankshaft and a valve camshaft;

a chain tensioner, said chain tensioner having a first end press-contacted with an outer side surface of the timing chain to apply tension to the timing chain and swingably attached to an engine main body via a pivot pin;

a timing chamber formed in a side wall of the engine main body for accommodating the timing chain;

an opening having a diameter greater than the drive sprocket is provided on a side of the drive sprocket on an outer side wall of the timing chamber;

a lid plate for covering the opening is removably secured to the engine main body; and a pair of support bosses being integrally formed with said lid plate and a crankcase of said engine main body, wherein the pivot pin is held between opposite walls of the engine main body and the lid plate by said support bosses.

3. The engine valve timing transmission apparatus according to claim 2, wherein the engine main body includes a cylinder block, a first crankcase half body connected to a one end of the cylinder block, and a second crankcase half body connected to and in cooperation with the first crankcase half body, said first and second crankcase half bodies rotatably holding the crankshaft.

4. The engine valve timing transmission apparatus according to claim 3, wherein the timing chamber is formed from the cylinder block to the second crankcase half body.

5. The engine valve timing transmission apparatus according to claim 3, wherein said opening is provided over the first and second crankcase half bodies.

6. The engine valve timing transmission apparatus according to claim 4, wherein said opening is provided over the first and second crankcase half bodies.

7. The engine valve timing transmission apparatus according to claim 3, wherein said pivot pin is held between opposite walls of said lid plate in a position covering the opening and the second crankcase half body.

8. The engine valve timing transmission apparatus according to claim 4, wherein said pivot pin is held between opposite walls of said lid plate in a position covering the opening and the second crankcase half body.

9. The engine valve timing transmission apparatus according to claim 6, wherein said pivot pin is held between opposite walls of said lid plate in a position covering the opening and the second crankcase half body.

10. The engine valve timing transmission apparatus according to claim 1, further comprising a generator driveably engaging with the crankshaft, said generator including a stator fixed to said lid plate.

11. The engine valve timing transmission apparatus according to claim 2, further comprising a generator driveably engaging with the crankshaft, said generator including a stator fixed to said lid plate.

12. The engine valve timing transmission apparatus according to claim 8, further comprising a generator driveably engaging with the crankshaft, said generator including a stator fixed to said lid plate.

13. The engine valve timing transmission apparatus according to claim 9, further comprising a generator driveably engaging with the crankshaft, said generator including a stator fixed to said lid plate.

14. An engine valve timing transmission apparatus comprising:

a timing chain engaging with a drive sprocket and a driven sprocket respectively fixed to a crankshaft and a valve camshaft;

a chain tensioner, said chain tensioner having a first end press-contacted with an outer side surface of the timing chain to apply tension to the timing chain and swingably attached to an engine main body via a pivot pin;

a timing chamber formed in a side wall of the engine main body for accommodating the timing chain;

an opening having a diameter greater than the drive sprocket is provided on a side of the drive sprocket on an outer side wall of the timing chamber;

a lid plate for covering the opening is removably secured to the engine main body, wherein the pivot pin is held between opposite walls of the engine main body and the lid plate; and a bearing boss projecting toward the timing chamber and integrally formed with the lid plate, said bearing boss rotatably supporting a rotor shaft of an oil pump.

15. An engine valve timing transmission apparatus comprising:

a timing chain engaging with a drive sprocket and a driven sprocket respectively fixed to a crankshaft and a valve camshaft;

a chain tensioner, said chain tensioner having a first end press-contacted with an outer side surface of the timing chain to apply tension to the timing chain and swingably attached to an engine main body via a pivot pin;

a timing chamber formed in a side wall of the engine main body for accommodating the timing chain;

an opening having a diameter greater than the drive sprocket is provided on a side of the drive sprocket on an outer side wall of the timing chamber;

a lid plate for covering the opening is removably secured to the engine main body, wherein the pivot pin is held between opposite walls of the engine main body and the lid plate;

a generator driveably engaging with the crankshaft, said generator including a stator fixed to said lid plate; and a cooling fan fixedly secured to a right end of the crankshaft in a position exterior to said generator.

16. The engine valve timing transmission apparatus according to claim 15, further comprising a radiator securing said cooling fan in a position between said radiator and said generator, wherein said radiator is secured to said engine main body.

17. The engine valve timing apparatus according to claim 2, further comprising a bush pivotably supporting said chain tensioner and being provided between said support bosses.

18. The engine valve timing apparatus according to claim 17, wherein said pivot pin is rotatably inserted within said bush.

* * * * *